United States Patent [19]

Jantzen et al.

[11] 4,206,709

[45] Jun. 10, 1980

[54] HOPPER CAR FOR LIQUID UNIT-TRAIN SERVICE

[75] Inventors: Steven L. Jantzen, St. Louis; Dallas W. Rollins, St. Charles, both of Mo.

[73] Assignee: ACF Industries, Incorporated, New York, N.Y.

[21] Appl. No.: 940,986

[22] Filed: Sep. 11, 1978

[51] Int. Cl.[2] ..... B61D 3/00

[52] U.S. Cl. ..... 105/243

[58] Field of Search ..... 105/253, 282 A, 282 P, 105/309, 310, 311; 141/35, 59, 374; 105/1 R, 243

[56] References Cited

U.S. PATENT DOCUMENTS

| | | | |
|---|---|---|---|
| 3,583,330 | 6/1971 | Freidman et al. | 105/243 |
| 3,918,604 | 11/1975 | Kersten | 105/243 |
| 4,002,192 | 1/1977 | Larssen | 105/1 R |

*Primary Examiner*—Richard A. Bertsch

*Attorney, Agent, or Firm*—Henry W. Cummings

[57] ABSTRACT

Enclosed covered hopper cars are interconnected by conduits to form a partial or complete unit-train for liquid lading service, particularly liquid petroleum. The conduits are at least partially flexible to negotiate curves in the road bed. Preferably the conduits joining adjacent hoppers extend between openings located in the upper portion of the end hoppers. Preferably at the bottom of each hopper a hopper floor is removably attached to a hopper outlet mounting flange. The hopper floor includes a lading opening. A longitudinal tube is located below the lading openings, extending between the end floor sheets. A conduit extends from the upper portion of one end hopper in the car to the longitudinal tube to enable the cars to be unloaded by positive pressure applied to an end car of a group of cars. The car may be converted to particulate solid lading service by removing the conduits extending between adjacent cars, closing the openings at the ends of the car, removing the hopper floor from the hopper mounting flange, and attaching to the hopper mounting flange an appropriate outlet for the particular particulate solid lading to be transported.

6 Claims, 7 Drawing Figures

HOPPER CAR FOR LIQUID UNIT-TRAIN SERVICE

BACKGROUND OF THE INVENTION

U.S. Pat. Nos. 1,542,116; 3,675,670; 3,722,556; 3,897,807; 3,906,995; 3,989,059; 4,002,192 and 4,007,766 disclose the use of interconnected railway tank cars used to transport large quantities of liquid lading, particularly liquid petroleum, from place to place.

However, in many parts of the United States and elsewhere in the world, pipe lines and cargo ships are under construction which will reduce or eliminate the need for such interconnected tank cars. As an example, in the United States, pipe lines are presently under construction to transport liquid petroleum inland from the West Coast to Texas and Montana. When these pipe lines are completed, the need for interconnected tank cars to transport the liquid petroleum inland will be largely eliminated.

Tank cars which have been used in liquid petroleum service may then be used to transport other liquid lading.

However, tank cars are not generally suitable for the transport of particulate solid lading.

it would be desirable to provide an interconnectable railway car which is adaptable for use in unit-train service in transporting liquid lading such as liquid petroleum, and which is convertible to a railway car which is adapted to transport particulate solid lading when the car is not needed for liquid lading service.

U.S. Pat. Nos. 3,731,053 and 3,791,168, assigned to the same assignee as the present application, disclose openings in the end bulkheads of railway hopper cars and conduits in fluid communication with the openings for the purpose of circulating conditioned air within the hopper car. However, these patents do not disclose conduits interconnecting adjacent hopper cars for liquid lading unit-train service.

U.S. Pat. No. 3,918,604 discloses a cargo container which is convertible between liquid and granular material service. However, this convertible container does not disclose conduits interconnecting adjacent containers for liquid lading unit-train service.

SUMMARY OF THE INVENTION

The object of the present invention is to provide an interconnected railway car which is adapted to transport liquid lading such as liquid petroleum in unit-train service, and which is convertible to a railway car adapted to transport solid particulate lading.

In accordance with the invention an enclosed covered hopper railway car is provided with openings at opposite ends of the car. Conduits extend through the openings and between adjacent cars to provide fluid communication between adjacent hopper cars to provide a unit-train or train section of at least several cars in length. Preferably the openings in the end hoppers are located in the upper portion of the hoppers. Preferably at the bottom of each hopper a removable floor is attached to a hopper mounting flange. The hopper floor includes a lading opening. A longitudinal conduit is located below the lading openings, and extends between the end floor sheets. Preferably at one end of the car a tube extends from the upper hopper opening to the longitudinal tube so that the car can be unloaded by positive pressure applied at one end of a train of cars.

Valves are preferably provided at each end of the car to close the hopper openings to prevent liquid from passing through the interconnecting conduits while the car is in transit. Thus a train of hopper cars can be loaded and unloaded by means of the valves in the end hoppers and the conduit means, without making separate loading and unloading connections for each car.

The car is readily converted to a car adapted for transport of particulate solid lading by removing the conduits interconnecting adjacent cars, closing off the openings at opposite ends of the car, removing the hopper bottom from the hopper mounting flange, and attaching an appropriate outlet for the particular particulate lading to be transported.

THE DRAWINGS

DESCRIPTION OF PREFERRED EMBODIMENTS

Figure 1:
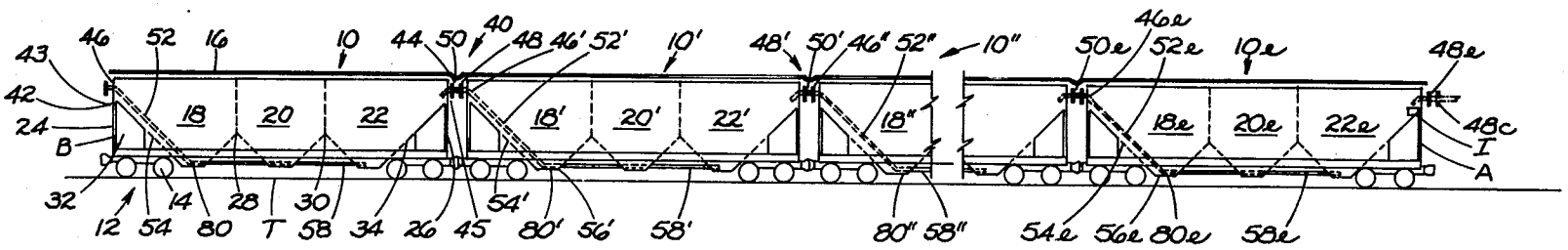
FIG. 1 is a side elevation view of a partial unit-train of hopper cars according to the present invention.

FIG. 1 shows a series of interconnected covered hopper cars indicated at 10, 10', 10'' and **10*e*. Each of the cars includes trucks 12 located below stub sills 13 (FIG. 2) at each end of the car including wheels 14** which support the cars on a track T.

Each of the cars includes a roof 16 and a plurality of hoppers indicated at 18, 20 and 22. A first end 24 is provided at the end of hopper 18 and a second end 26 is provided at the outer end of hopper 22. Transverse bulkheads 28 and 30 respectively divide hoppers 18 and 20; and 20 and 22. End supports 32 and 34 are provided at each end of the car for the respective end hoppers 18 and 22. The construction of the hopper cars as described thus far is described in greater detail in U.S. Pat. Nos. 3,339,499 and 3,490,387, both assigned to the assignee of the present application. Reference may be made to these patents for a more detailed description of the hopper car construction.

Conduit means for interconnecting adjacent ones of the hopper cars 10 is provided, indicated in the drawings generally at 40. This conduit means includes openings 42 and 44 located in end bulkheads 43 and 45 in respective end hoppers 18 and 22. A front rigid conduit 46 is rigidly attached to end bulkhead 43 and a rigid conduit 48 is attached to end bulkhead 45 in fluid communication with respective openings 42 and 44. A flexible conduit 50 joins rear rigid conduit 48 with a front rigid conduit 46' of adjacent hopper car 10', similar to front rigid conduit 46 in hopper car 10. Flexible conduit 50 may be held in place by shrink fit, interference fit or mechanical fasteners. Flexible conduit 50 has sufficient flexibility to allow the car to traverse curves without becoming disconnected. Suitable flexible conduits are commercially available. See, for example, Uniroyal Corporation catalogue "Hand-Made Multi-Flex® Products," page 11. The flexible conduit may have a diameter greater or less than that of the rigid conduits to which it is attached.

Hopper car 10' is constructed in the same manner as hopper car 10 including hoppers 18', 20' and 22'. Hopper 10' also includes a rear rigid fitting 48' to which is connected a flexible coupling 50' which is also connected to front rigid conduit fitting 46" in another adjacent hopper car 10" similar to conduits 46 and 46'.

Within each car, conduits 52, 52', 52", 52*e* extend downwardly from respective front rigid conduits 46, 46', 46", 46*e* along end hopper slope sheet 54, 54', 54", 54*e* to the outlet portion 56, 56', 56", 56*e* of respective hoppers 18, 18', 18", 18*e*. Longitudinal tubes 58, 58', 58", 58*e* provide fluid communication between respective hoppers 18, 20, and 22; 18', 20' and 22'; 18", 20" and 22"; and 18*e*, 20*e* and 22*e*.

A portion of a train or an entire train of hopper cars may be so interconnected, to facilitate loading and unloading of the hopper. With the cars so interconnected, each car does not have to be separately connected to a conduit for loading and unloading the same. Thus considerable savings in unloading time and in unloading labor cost can be achieved with this arrangement.

Figures 2, 3, 4, 5, 6, 8:
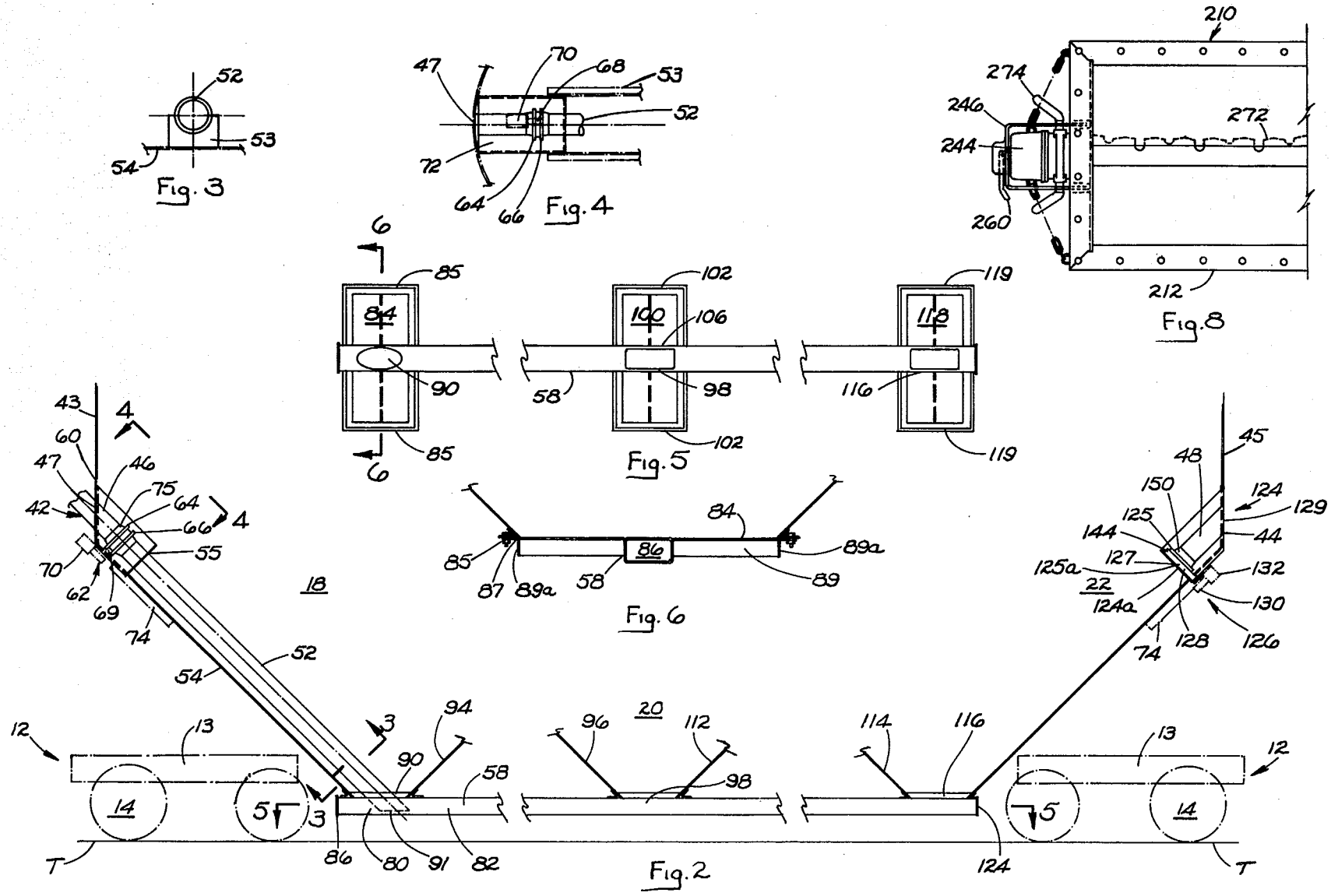
FIG. 2 is an enlarged schematic elevation view of one of the hopper cars in the hopper car train shown in FIG. 1.
FIG. 3 is a sectional view looking in the direction of the arrows along the line 3—3 in FIG. 2.
FIG. 4 is a view looking in the direction of the arrows along the line 4—4 in FIG. 2.
FIG. 5 is a plan view looking in the direction of the arrows along the line 5—5 in FIG. 2.
FIG. 6 is a vertical sectional view looking in the direction of the arrows along the line 6—6 in FIG. 5.

As shown in enlarged FIG. 2, end bulkhead 43 is cut away as indicated at 60 near the transverse mid-portion or center line of the car. Gussets 53 (FIG. 3) welded to slope sheet 54 support conduit 52 inside the car. Conduit 52 is also welded to a hopper closure plate 55. Conduit 52 extends outboard of closure plate 55 and a valve assembly 62 is mounted thereon.

Valve assembly 62 includes abutting mounting flanges 64 and 66 between which is mounted a butterfly valve 68 (FIG. 4), having a shaft 69. An air cylinder 70 is attached with a bracket structure 72 having a piston 71 to rotate shaft 69 and move butterfly valve 68 between open and closed positions. Such butterfly valves are of conventional construction and are commercially available. See Catalogue No. 1274 of Center Line, Inc.; Box 3477; Tulsa, Okla. 74101. An air line 74 is provided to actuate air cylinder 70. Such air cylinder and piston arrangements are also conventional, see page 25 of the same catalogue. Other valves and valve actuators may also be used. Front rigid conduit 46 is welded to fitting 75 and extends outboard of the car, through closure plate 47 which contains opening 42.

Tube 52 extends downwardly into a sump 80 defined in part by the end portion 82 of longitudinal tube 58. As shown in FIG. 6, tube 58 has a rectangular cross section. An end wall 86 closes tube 18 and sump 80. An oval-shaped opening 90 (FIG. 5) is provided to provide fluid communication with conduit 52. Conduit 52 is cut horizontally at 91 near the bottom of sump 80.

Hopper bottom 84 is attached to a mounting flange 85 by welding or with suitable fasteners 87 in such a manner that bottom 84 is removable for a purpose to be hereinafter described. Hopper bottom includes strengthening ribs 89 having longitudinal end portions 89*a* (FIG. 6). Tube 58 is welded to hopper bottom 84 which provides support therefor. Tube 58 extends longitudinally of the car between hoppers 18 and 20 below slope sheets 94 and 96. In the lower portion of hopper 20, tube 58 includes an opening 98 to provide fluid communication between the tube and hopper 20. A hopper bottom 100 is removably attached with fasteners to a hopper mounting flange 102 in a manner similar to that shown in FIGS. 5 and 6. Longitudinal tube 58 is welded to bottom 100 as indicated at 106 which provides support therefor.

Tube 58 extends longitudinally below slope sheets 112 and 114 and is provided with an opening 116 to provide fluid communication to hopper 22. A hopper bottom 118 is removably attached to a mounting flange 119 in the same manner as shown in FIG. 6. An end plate 124 closes tube 58.

End bulkhead 45 is again cut away near the car center line as indicated at 124. A hopper closure plate 125 including opening 124*a* is provided in cut-away portion 124. A mounting flange 125*a* is provided around opening 124*a* into hopper 22. A butterfly valve assembly 126 similar to valve assembly 62 is provided to open and close this opening. A butterfly valve 127 has a valve shaft 128 which is rotated by piston 130 from air cylinder 132, similar to air cylinder 70 and piston 72, actuated by air line 74 as described above.

Rear rigid conduit 48 is attached to a mounting flange 150 and extends through opening 44 in closure plate 129. As shown in FIG. 1 a flexible coupling 50 joins rear rigid coupling 48 and a front rigid coupling 46' on an adjacent car similar to rigid coupling 46. Valve assemblies similar to valve assemblies 62 and 126 are provided in hopper cars 10', 10" and 10*e*. Air pressure may be applied to air line 74 to simultaneously close valves 68 and 127 in each car, and in multi-car units.

The car is preferably loaded from left to right in FIG. 1 with liquid lading initially flowing down tube 52 and into sump 80. From there, lading flows into hopper 18 and through tube 58 into hoppers 20 and 22. When car 10 is full lading passes through coupling 50 into car 10' and the same loading sequence follows as cars 10' and 10" are loaded.

This loading sequence follows in all cars until end car 10*e* (FIG. 1) is reached. In car 10*e* conduit 48*e* is connected to a suitable vent system which may be utilized to recycle vaporous portions of the lading or otherwise dispose of the vapors resulting from the lading operation. A liquid level indicator I of conventional construction may be utilized to signal manual shut-off of the loading operation, or automatic shut-off of the loading operation, as is known in the art.

For unloading, pressure is applied to conduit connection 48*e* through a suitable conduit 48*c* connected at the unloading site, and the lading is forced out successively from right to left by means of the pressure applied to connection 48*e* in car 10*e*. Conduits 52*e*, 52", 52' and 52 ensure that all of the lading, including that in the lower portion of the respective sumps 80*e*, 80", 80' and 80, will be unloaded from each car. The pressure applied must be sufficient to exceed the static head of the weight of the liquid lading in the car. Valve assemblies 62 and 126 are opened.

Figure 7:
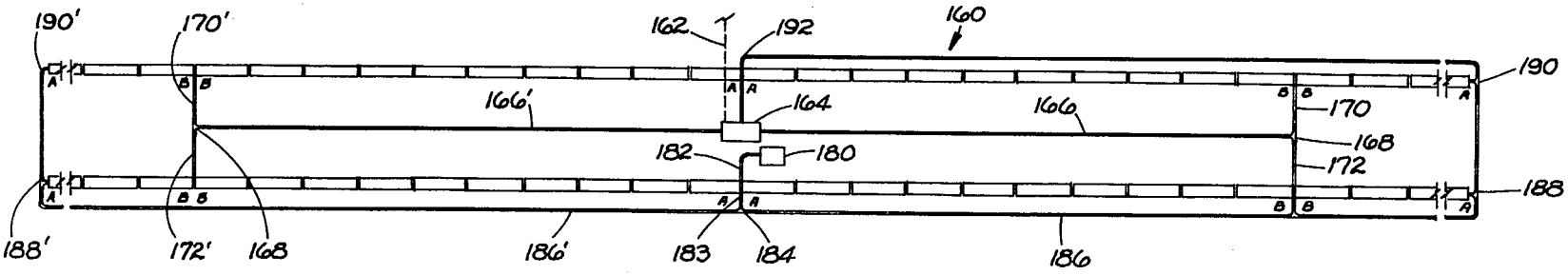
FIG. 7 is a schematic view illustrating a loading and unloading sequence for the hopper car train sections in the present invention.

In FIG. 7 an installation for loading and unloading a unit-train of eighty (80) cars including eight (8) units of ten (10) cars is illustrated. This installation is indicated generally at 160 and includes a conduit 162 leading from a storage tank (not shown) to a liquid pump 164. A conduit 166 extends from the liquid pump 164 to a "Y" connection 168. From the "Y" a pair of lines 170 and 172 extend to the B loading end of four sets of ten (10) units of cars. A similar line 166' extending from the pump 164 in the opposite direction includes a "Y" 168' and a pair of lines 170' and 172'. The ends of the lines 170, 172, 170' and 172' are provided with "Y" connections to connect to the respective B ends of connections 46 on the end car of each of the ten (10) car units illustrated in FIG. 7. Ten (10) unit cars are thus loaded by pump 164. The A end of the last car of a ten (10) car unit is connected to a suitable vent conduit. This vent conduit may be either vented to the atmosphere or may be utilized to recycle vapors resulting from the loading operation to the container.

Pump 164 is used to pump liquid petroleum from the storage tank through conduits 170, 172, 170' and 172' to convey the liquid petroleum into the B end fitting 46 of the respective ten (10) car units. A liquid level gauge I is provided in the last car 10*e* of each ten car unit. When this car is filled the liquid level gauge may be used to signal manual shut-off of a respective loading conduit or automatic shut-off as desired.

For unloading, an air pressure pump 180 includes a conduit 182 and a "Y" 183 extending to adjacent A ends of adjacent ten (10) car units. Line 182 further includes a "Y" 184 and a pair of lines 186, 186' extending to fittings 48*e* in opposite directions to apply pressure to the A ends of additional ten (10) car units as illustrated at 188, 190, 192, 188' 190' to fittings 48*e*. Suitable couplings are applied to the connections 183, 188, 190, 188' and 190' and 192 to apply pressure to the fittings 48*e* to apply unloading pressure to the respective ten (10) car units. As the lading is unloaded from each ten (10) car unit, lading passes from the respective A ends through the conduits 170, 172, 170', 172' through the conduits 160, 160', through the oil pump to a storage tank (not shown) by means of conduit 162.

With this arrangement a unit-train of eighty (80) cars can be loaded and unloaded relatively quickly without attaching unloading hoses individually to each of the eighty (80) cars.

Hopper bottoms 84, 100 and 118 and longitudinal tubes 58 are removed by disconnecting the fasteners 85, which hold respective hopper bottoms 84, 100, 118 in place. The entire longitudinal tube and hopper bottom assembly may then be removed from the car.

Suitable gravity or pneumatic outlets or gravity-pneumatic outlets may then be attached to the mounting flanges 85. A wide variety of such outlets are available on the open market. An example of an outlet which may be used is disclosed in U.S. Pat. No. 3,778,114 (1973), which is hereby incorporated into the present application by this reference, and is shown in FIG. 8. Very briefly, flange 212 is used to attach the outlet 210 to mounting flange 85 (FIG. 6). Handle 260 is pivoted to release bail 246 and remove end cap 244. Handles 274 may then be rotated from either end to move valve element 272 between closed and partially open, and full open positions. U.S. Pat. No. 3,778,114 may be referred to for a more detailed description.

The following U.S. patents illustrate other examples of outlets which may be attached. All of the patents are assigned to the same assignee of the present application and are hereby incorporated into the present application by this reference U.S. Pat. Nos.: 4,036,532; 3,874,569; 3,877,392 and 3,708,209. The choice of the particular outlet used will depend upon the particular ladings which are contemplated for transport.

For converting the cars to solid particulate lading service, the conduits 50, 50', 50'' are removed from rigid conduits 46 and 48. Rigid conduits 46 and 48 and valve assemblies 62 and 126 may or may not be removed. Openings 42 and 44 are preferably closed with a suitable plate welded to plates 47 and 125. Conduit 52 may be removed from the inside of the car by burning out the welds which hold reinforcing gussets 53 in place.

It is thus apparent that the hopper cars of the present invention are convertible from liquid lading service to solid lading service and vice versa.

What is claimed is:

1. An enclosed covered hopper railway car having a plurality of hoppers and end openings at opposite ends of the car located in the upper portion of end hoppers; an external conduit extending through each of said end openings and adapted to engage an end opening in an adjacent car to provide fluid communication between adjacent hopper cars to provide a unit train of at least several cars in length; a tube extending from at least one end opening to the lower portion of one of said end hoppers whereby the car can be unloaded by positive pressure applied at one end of a train of cars; a hopper bottom attached to the lower portion of each of said hoppers; a longitudinal tube extending through the lower portion of adjacent hoppers below said bottoms to provide fluid communication between adjacent hoppers; openings in said hopper bottoms providing fluid communication with said longitudinal tube; whereby said longitudinal tube provides fluid communication between adjacent hoppers to facilitate loading and unloading said car with liquid lading.

2. A hopper car unit train assembly for liquid lading service comprising:

a plurality of enclosed covered hopper cars with end openings located in the upper portion of adjacent end hoppers; said openings respectively being interconnected by external conduits extending between adjacent cars having sufficient flexibility to negotiate curves in a railway roadbed; a hopper floor located at the bottom of each hopper attached to said hopper; an internal conduit extending from one of said end openings to the bottom of said hopper whereby the cars may be unloaded by positive pressure applied to an end car of a group of cars; at least some of said cars including more than one hopper and fluid communication between adjacent hoppers in said multi-hoppered cars being provided by a longitudinal tube extending through the lower portion of adjacent hoppers below said bottoms; openings in said hopper bottoms providing fluid communication with said tube; whereby said longitudinal tube provides fluid communication between adjacent hoppers to facilitate loading and unloading said car with liquid lading.

3. An enclosed covered hopper railway car having a plurality of hoppers and end openings at opposite ends of the car located in the upper portion of end hoppers; an external conduit extending through each of said end openings and adapted to engage an end opening in an adjacent car to provide fluid communication between adjacent hopper cars to provide a unit train of at least several cars in length; a tube extending from at least one end opening to the lower portion of one of said end hoppers whereby the car can be unloaded by positive pressure applied at one end of a train of cars; a hopper bottom attached to the lower portion of each of said hoppers; a longitudinal tube extending through the lower portion of adjacent hoppers below said bottoms to provide fluid communication between adjacent hoppers; openings in said hopper bottoms providing fluid communication with said longitudinal tube; said bottom being removably attached whereby the car is readily converted to a car adapted for transport of particulate solid lading by removing said hopper bottoms from said hoppers and attaching an appropriate outlet to each hopper for the particular particulate lading to be transported.

4. A covered hopper car according to claim 3 wherein valves are provided at each end of the car to close the end openings to prevent liquid from passing through said external conduits while the car is in transit, whereby a train of hopper cars can be loaded and unloaded by means of the valves in the end hoppers and the external conduit means, without making separate loading and unloading connections for each car.

5. A hopper car unit train assembly for liquid lading service comprising:

a plurality of enclosed covered hopper cars with end openings located in the upper portion of adjacent end hoppers; said openings respectively being interconnected by external conduits extending between adjacent cars having sufficient flexibility to negotiate curves in a railway roadbed; a hopper floor located at the bottom of each hopper removably attached to said hopper; an internal conduit extending from one of said end openings to the bottom of said hopper whereby the cars may be unloaded by positive pressure applied to an end car of a group of cars; at least some of said cars including more than one hopper and fluid communication between adjacent hoppers in said multi-hoppered cars being provided by a longitudinal tube extending through the lower portion of adjacent hoppers below said bottoms; openings in said hopper bottoms providing fluid communication with said tube; said hopper cars being convertible to particulate solid lading service by removing the external conduits extending between adjacent cars, removing the hopper floor from said hoppers, and attaching an appropriate outlet for the particular solid lading to be transported to each hopper.

6. A hopper car unit-train assembly according to claim 5 including valve means located in each car effective to close off said conduits while the cars are in transit.

* * * * *